US005820750A

United States Patent [19]

Blum et al.

[11] Patent Number: 5,820,750

[45] Date of Patent: Oct. 13, 1998

[54] THERMAL DECOMPOSITION OF NAPHTHENIC ACIDS

[75] Inventors: Saul Charles Blum, Edison; William Neergaard Olmstead, Murray Hill, both of N.J.; Roby Bearden, Baton Rouge, La.

[73] Assignee: Exxon Research and Engineering Company, Florham Park, N.J.

[21] Appl. No.: 785,372

[22] Filed: Jan. 17, 1997

Related U.S. Application Data

[63] Continuation of Ser. No. 571,049, Dec. 12, 1995, abandoned, and a continuation-in-part of Ser. No. 546,202, Oct. 20, 1995, abandoned, which is a continuation-in-part of Ser. No. 390,729, Feb. 17, 1995, abandoned.

[51] Int. Cl.[6] ..... C10G 17/00

[52] U.S. Cl. ..... 208/263

[58] Field of Search ..... 208/263, 189

[56] References Cited

U.S. PATENT DOCUMENTS

| | | | |
|---|---|---|---|
| 1,953,353 | 4/1934 | Lazar et al. | 208/263 |
| 2,040,098 | 5/1936 | Parmelee | 208/263 |
| 2,040,104 | 5/1936 | Radasch | 208/263 |
| 2,227,811 | 1/1941 | Moser | 208/263 |
| 2,966,456 | 12/1960 | Honeycutt | 208/263 |
| 5,250,175 | 10/1993 | Des Ormeaux | 208/263 |

FOREIGN PATENT DOCUMENTS

| | | | |
|---|---|---|---|
| 612730 | 1/1961 | Canada | 208/263 |
| 496779 | 12/1938 | United Kingdom | 208/263 |

*Primary Examiner*—Helane Myers
*Attorney, Agent, or Firm*—Ronald D. Hantman

[57] ABSTRACT

Petroleum acids, e.g., naphthenic acids, are removed from crudes or crude fractions by thermal treatment.

19 Claims, 1 Drawing Sheet

IMPACT OF WATER ON % TAN REDUCTION

THERMAL DECOMPOSITION OF NAPHTHENIC ACIDS

This is a continuation of application Ser. No. 571,049, filed Dec.12, 1995 abandoned and is a continuation-in-part of U.S. Ser. No. 546,202 abandoned filed Oct. 20, 1995 which is a continuation-in-part of U.S. Ser. No. 390,729 filed Feb. 17, 1995 abandoned.

FIELD OF THE INVENTION

This invention relates to the decomposition of naphthenic acids present in crude oils. More particularly, this invention relates to a thermal, non-catalytic treatment for decomposing these naphthenic acids.

BACKGROUND OF THE INVENTION

The presence of relatively high levels of petroleum acids, e.g., naphthenic acids, in crude oils or fractions thereof is a bane of petroleum refiners and more recently of producers, as well. Essentially, these acids, which are found to greater or lesser extent in virtually all crude oils, are corrosive, tend to cause equipment failures, lead to high maintenance costs, more frequent turnarounds than would other wise be necessary, reduce product quality, and cause environment disposal problems.

A very significant amount of literature, both patents and publications, exists that deal with naphthenic acid removal by conversion or absorption. For example, many aqueous materials can be added to crudes or crude fractions to convert the naphthenic acids to some other material, e.g., salts, that can either be removed or are less corrosive. Other methods for naphthenic acid removal are also well known including absorption, on zeolites, for example. Additionally, one common practice for overcoming naphthenic acid problems is the use of expensive alloy materials in refinery or producer equipment that will encounter relatively high naphthenic acid concentrations. Another common practice involves blending off crudes with high total acid numbers (TAN) with crudes of lower TAN, the latter, however, being significantly more costly than the former. One reference, Lazar et al (U.S. Pat. No. 1,953,353) teaches naphthenic acid decomposition of topped crudes or distillates, effected at atmospheric pressure between 600° F. and 750° F. However, it only recognizes $CO_2$ as the sole gaseous non-hydrocarbon, naphthenic acid decomposition product and makes no provision for conducting the reaction with a continuous inert gas sweep to avoid build-up of reaction inhibitors.

Nevertheless, there remains a need for eliminating or least substantially reducing petroleum acid concentration in crudes or fractions thereof that is low cost and refinery friendly, particularly crudes or fractions thereof where the total acid number (TAN) is above about 2 mg KOH/gm oil, as determined by ASTM method D-664.

SUMMARY OF THE INVENTION

In accordance with this invention, the petroleum acid concentration of feeds containing such acids may be substantially reduced, or at the least, reduced to the level where these feeds may be treated in plain carbon steel vessels, by thermally treating the feed, thereby decomposing the acids. Consequently, TAN can be significantly reduced. In the context of this invention, thermal treatment, in addition to its normal meaning also means the absence of any catalyst for promoting the conversion of naphthenic acids, the absence of any material added to react or complex with naphthenic acids, and the absence of absorbents for naphthenic acids, i.e., the absence of any material used for the purpose of removing naphthenic acids.

The thermal treatment amounts to heating the feed to a temperature of at least about 400° F., preferably at least about 600° F. for a period of time sufficient to reduce substantially TAN of the feed while constantly sweeping away inhibitors indigenous or formed during the decomposition. Inhibitors are primarily water vapor, magnified by the presence of $CO_2$ and/or CO.

The thermal treatment process is, of course, a time-temperature dependent relationship once the threshold temperature level is attained. Thus, higher temperatures are also useful with a corresponding decrease in residence time at those higher temperatures. However, because of the nature of the feeds, premature cracking of the bulk hydrocarbons is to be avoided or minimized, e.g., based on the feed, less than about 0.5 wt % gaseous hydrocarbon products, and preferably, based on the feed, less than 0.2 wt % of gaseous hydrocarbon products is produced. The gases that are produced are primarily water vapor, $CO_2$ and CO by virtue of the decomposition of the naphthenic acids. Other gases that may be produced by the very low level of cracking include light hydrocarbon gases, e.g., $C_1$–$C_4$ alkyls or iso-alkyls, and hydrogen in small amounts.

The process of this invention preferably reduces TAN to levels of less than about 1.5 mg KOH/gin oil, more preferably less than about 1 mg KOH/gm oil, still more preferably to less than about 0.5 mg KOH/gm oil, as measured by ASTM D-664.

DESCRIPTION OF PREFERRED EMBODIMENTS

Figure 1:
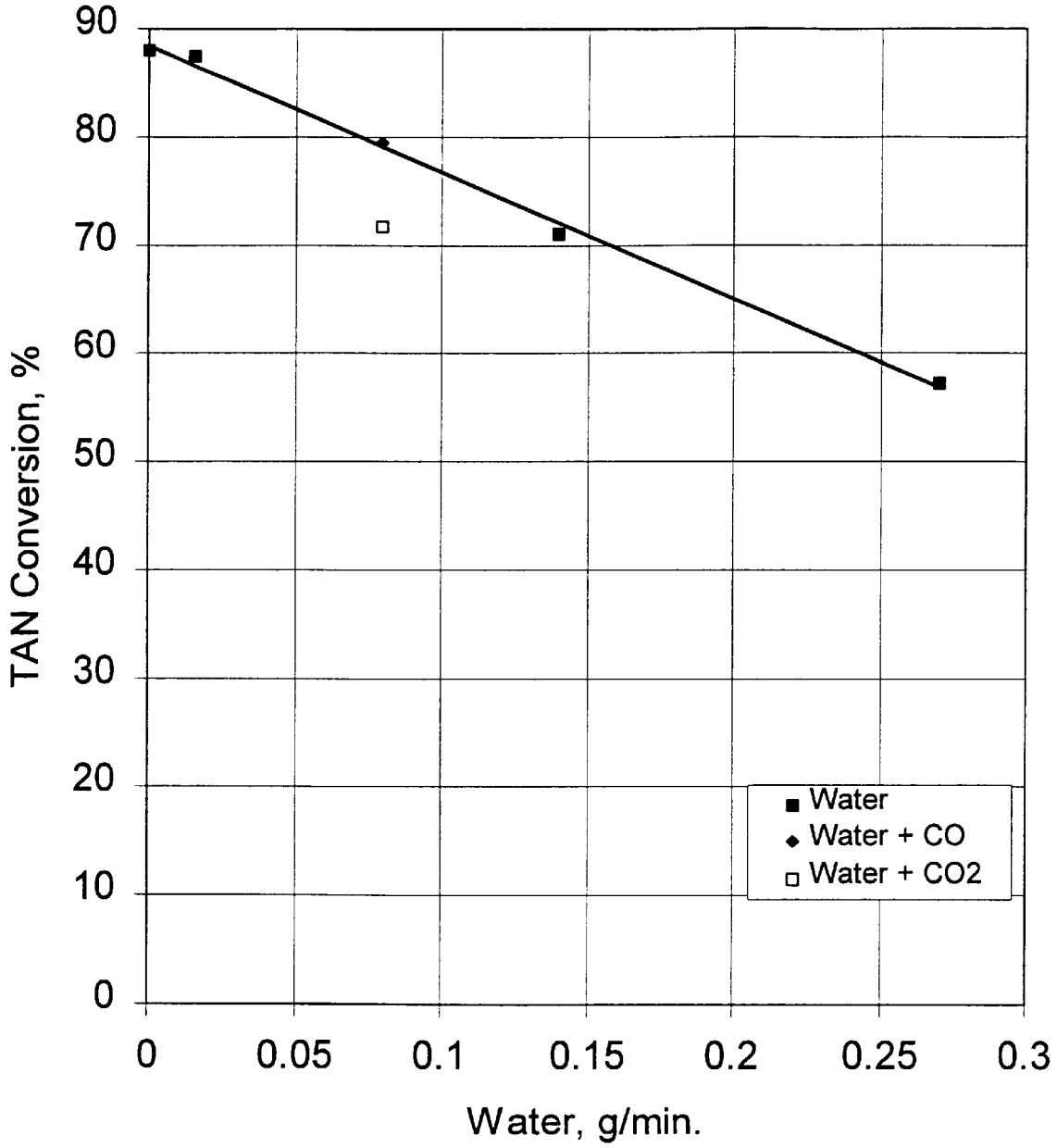
FIGURE 1 shows TAN reduction versus water for Example 4.

Feeds that may be effectively treated by this thermal treatment process include feeds containing naphthenic acids such as whole crudes or crude fractions. Crude fractions that may be treated are topped crudes (since few naphthenic acids are present in 400° F.—naphtha), atmospheric residua, and vacuum gas oils, e.g., 650°–1050° F. Preferred feeds include whole and topped crudes and vacuum gas oils, particularly whole and topped crudes.

The feed may be treated at super-atmospheric, atmospheric or sub-atmospheric pressure, e.g., 0.1 to 100 atmospheres, preferably less than about 15 atmospheres, more preferably 1–10 atmospheres, and preferably in an inert atmosphere, e.g., nitrogen or other non-oxidizing gases. Because thermal treatment leads to acid decomposition, provisions for venting the gaseous decomposition products, i.e., $H_2O$ vapor, $CO_2$ and CO, as well as the minimal cracking products, is appropriate. It is especially necessary to continuously sweep away water vapor produced in the acid decomposition or indigenous with the feed to minimize inhibition of the acid decomposition process. Any light ends or light cracked hydrocarbon products can be recovered by condensation, and, if desirable, recombined with the treated feed. In practice, soaking drums with venting facilities may be used to carry out the thermal treatment process. In a preferred embodiment, $CO_2$ and CO would also be swept away. This sweep gas may be natural gas or other light hydrocarbon gases as may be generally available at refineries or production facilities. Purge rates of sweep gas would be in the range of 1–2000 standard cubic feet per barrel of feed (SCF/Bbl). Preferably, the gaseous products would be removed from the reaction zone such that $CO+CO_2$ partial pressure is below 0.5 psia and the $H_2O$, partial pressure is below about 0.2 psia.

While treatments are time-temperature dependent, temperatures are preferably in the range of 600°–900° F., more preferably 700°–800° F. Treatment (residence time at temperature) times may vary widely and are inversely related to temperature, e.g., 30 seconds to about 10 hours, preferably 1–90 minutes, more preferably 30–90 minutes. Of course, at any given temperature longer treatment times will generally result in lower TAN values, while taking care not to exceed the cracking levels previously mentioned.

As mentioned, soaking drums may be employed to carry out the process either on a batch or continuous basis. Engineers skilled in the art will readily envisage tubular reactions to effect the process.

The following examples further illustrate the invention, and are not meant to be limiting in any way.

EXAMPLE 1

Experiments conducted in an open reactor (all, except as otherwise noted) included distillation equipment similar to the described in ASTM D-2892 or ASTM D-5236. About 300 grams of a sample of 650° F.+portion of crude was placed in a distillation flask. (Whole crude, while readily usable, was not used in order to prevent physical losses of the 650° F.—portion of the sample). The sample was rapidly heated to the desired temperature and held at that temperature for up to six hours under an inert atmosphere, e.g. nitrogen. Agitation was effected either by bubbling nitrogen through the sample, and preferably by stirring with a magnetic stirrer bar. Aliquots were withdrawn periodically for TAN measurements.

In a series of experiments, a 650° F.+fraction of an African crude (Bolobo) was exposed to six hour heat soaks within a temperature range from 400° F. to 650° F. interspersed with overnight cooling to room temperature for three consecutive days. These experiments were carried out at atmospheric pressure under a nitrogen atmosphere. The heat soak was sequential: first hour at 400° F., second hour at 450° F., third hour at 500° F., fourth hour at 550° F., fifth hour at 600° F., sixth hour at 650° F. The sample was cooled to room temperature and allowed to sit overnight before aliquots were taken. Naphthenic acid content was monitored by TAN initially and after each day. The results are shown in Table 1 below.

TABLE 1

| Test Day | TAN | (mg KOH/gm oil) |
|---|---|---|
| 0 (initial TAN) | 3.02 | (1) |
| 1 | 2.22 | 2.22(2) |
| 2 | 1.80, | 1.77(2) |
| 3 | 1.17 | 1.25(2) |

(1)from crude assay
(2)two aliquots taken after each day and independently tested The TAN decreased almost linearly over the course of these experiments.

EXAMPLE 2

In a series of experiments, thermally treated naphthenic acid decomposition was conducted in open and closed reactors. In the open reactor, produced gas could slowly escape while in the closed reactor, product gases were retained. TAN reduction and gas make were determined and results are shown in Table 2.

TABLE 2

| TEST NUMBER | FEED | TEMPERATURE, °F. | TIME, MINUTES | TYPE | TAN RED. % | GAS YIELD, WT % |
|---|---|---|---|---|---|---|
| 1 | Bolobo Crude | 700 | 20 | closed | 0 | .03 |
| 2 | Bolobo Crude | 700 | 50 | closed | 0 | .04 |
| 3 | Bolobo Crude | 700 | 100 | closed | 0 | .05 |
| 4 | Kome 650° F.+ | 725 | 240 | closed | 40 | n.a. |
| 5 | Kome 650° F.+ | 725 | 240 | open | 66 | n.a. |

The closed reactor consisted of tubing bombs (25 gm oil in 65 cc reactor volume), or mini bombs (5 gm oil in 12 cc reactor volume).

The results showed that in closed systems no TAN reduction was achieved, suggesting that autogenous pressure increases prevented acid decomposition. A direct comparison between an open and closed system, in experiments 4 and 5, showed a better than 50% increase in TAN reduction for the open system over the closed system.

EXAMPLE 3

In another series of experiments thermally treated naphthenic acid decomposition was conducted in an autoclave to demonstrate the beneficial effect of sweeping gaseous products from the reaction zone. In experiment Test 1, produced gases were continuously swept away with helium at a rate of 1275 SCF/Bbl while in experiment Test 2, product gases were retained such that the maximum pressure rose to 100 psig. TAN was determined and results are shown in Table 3.

TABLE 3

| Test Number | Feed | Temperature (°F.) | Time (Minutes) | Maximum Pressure (psig) | Sweep Rate (SCF/Bbl) | % TAN Reduction |
|---|---|---|---|---|---|---|
| 1 | Kome/Bolobo Crude Blend | 725 | 60 | 45 | 1275 | 84.9 |
| 2 | Kome/Bolobo Crude Blend | 725 | 60 | 100 | 0 | 44.3 |

The results confirm that sweeping the gases from the reaction zone result in significantly improved TAN reduction, 84.9% relative to an initial TAN of 5.3. In contrast, only 44.3% TAN reduction was achieved with no gas sweep.

EXAMPLE 4

In another series of autoclave experiments, the effect of inhibition by water vapor, in the presence or absence of $CO_2$ and/or CO was studied with respect to TAN reduction by thermal treatment. The results are shown in Table 4. In each test, the estimated water partial pressure ($H_2O$, psia), resulting from TAN conversion was less than 0.2 (as distinguished from the added water line).

TABLE 4

Tests with Dewatered Kome + Bolobo Crude Blend (TAN = 5.33) as Feed (Thermal Treatment at 750° F. for 60 minutes, 45 psig and 1275 SCF/Bbl Gas Sweep)

| Test Number | 1 | 2 | 3 | 4 | 5 | 6 | 7 |
|---|---|---|---|---|---|---|---|
| $CO_2$ + CO, psia | 0.45 | 0.42 | 0.43 | 0.32 | 0.34 | 0.38 | 0.42 |
| $CO_2$ added, psia | — | — | — | — | 12.3 | — | 6.2 |
| CO added, psia | — | — | — | — | — | 12.1 | 6.2 |
| $H_2O$ added, psia | — | 3.1 | 27.6 | 51.3 | 1.66 | 16.4 | 16.6 |
| $H_2O$ added, g/minute | — | 0.016 | 0.14 | 0.27 | 0.08 | 0.08 | 0.08 |
| % TAN Reduction | 88.2 | 87.4 | 71.0 | 57.3 | 71.7 | 79.4 | 79.4 |

In experiment Test 1, with no water vapor added and carbon oxides only resulting from naphthenic acid decomposition, the highest TAN reduction of 88% was achieved for this set of tests. In Test 2, Test 3 and Test 4, water vapor added to the sweep gas in increasing amounts resulted in progressively less TAN reduction than in the base case. In Test 5, Test 6 and Test 7, similar amounts of water were added along with $CO_2$, CO and $CO_2$+CO, respectively. All three showed lower % TAN reduction levels compared to the referenced Test 2.

These effects may be readily seen in FIG. 1, a plot of % TAN Reduction vs. $H_2O$ added in g/min., using results from Table 4.

What is claimed is:

1. A process for reducing the total acid number (TAN) of whole crude or crude fraction feeds which comprises (a) thermally treating the feed in a treatment zone at a temperature of at least 400° F. and a pressure between 0.1 and 100 atmospheres for a period of time sufficient to substantially reduce the TAN and (b) removing water vapor which would inhibit said TAN reduction, simultaneously during said thermal treating with a sweep gas rate in the range of 1–2000 standard cubic feet per barrel of feed.

2. The process of claim 1 wherein said process produces gaseous reactions products, water, CO, and $CO_2$, which are removed simultaneously from the treatment zone.

3. The process of claim 2 wherein said gaseous reaction products are removed such that CO+$CO_2$, partial pressure, is less than 0.5 psia and water, partial pressure is less than 0.2 psia.

4. The process of claim 2 wherein the gaseous reaction products, CO, $CO_2$, water vapor and light hydrocarbons, are removed from the treatment zone.

5. The process of claim 2 wherein essentially all gaseous reaction products are removed from the treatment zone.

6. The process of claim 1 wherein the feed is a dewatered crude.

7. The process of claim 2 wherein the feed has a TAN in excess of 2 mg KOH/gm feed.

8. The process of claim 7 wherein the thermally treated feed has a TAN of less than about 1.5 mg KOH/gin feed.

9. The process of claim 7 wherein treatment temperature is at least about 600° F.

10. The process of claim 7 wherein treatment temperature ranges from about 600°–900° F.

11. The process of claim 9 wherein the treatment time ranges from about 1 minute to about 10 hours.

12. The process of claim 9 wherein the thermally treated feed has a TAN of less than about 1.0 mg KOH/gm feed.

13. The process of claim 9 wherein the feed is a whole crude.

14. The process of claim 9 wherein the feed is a topped crude.

15. The process of claim 9 wherein the feed is an atmospheric residuum.

16. The process of claim 9 wherein the feed is a 650°–1050° F. vacuum gas oil.

17. The process of claim 9 wherein, based on the feed, less than about 0.5 wt % of produced gaseous hydrocarbon products are in the gas phase.

18. The process of claim 9 wherein treating pressure is about 1–10 atmospheres.

19. The process of claim 4 wherein said light hydrocarbons are $C_1$ to $C_4$ hydrocarbons.

* * * * *